US005404597A

United States Patent [19]

Hennessy

[11] Patent Number: 5,404,597

[45] Date of Patent: Apr. 11, 1995

[54] VACUUM ASSIST TOILET TRAP

[75] Inventor: Arnold Hennessy, Wellington, Canada

[73] Assignee: Fluidmaster, Inc., Anaheim, Calif.

[21] Appl. No.: 185,554

[22] Filed: Jan. 24, 1994

[51] Int. Cl.[6] ..... E03D 11/18

[52] U.S. Cl. ..... 4/424; 4/328; 4/421; 137/247.41; 137/247.29

[58] Field of Search ..... 4/328, 421–430; 137/136, 138, 139, 247.41, 247.29, 247.49, 247.25

[56] References Cited

U.S. PATENT DOCUMENTS

| | | | |
|---|---|---|---|
| 541,274 | 6/1895 | Hamilton | 4/424 |
| 622,205 | 4/1899 | Burnett | 4/424 |
| 1,062,413 | 5/1913 | Payne | 4/424 |
| 3,224,013 | 12/1965 | Tubbs | 4/424 |
| 4,145,776 | 3/1979 | Crosby et al. | 4/425 |
| 5,054,133 | 10/1991 | Pickerrel et al. | 4/425 |
| 5,142,712 | 9/1992 | Hennessy | 4/328 |
| 5,170,515 | 12/1992 | Kai et al. | 4/421 |

*Primary Examiner*—Henry J. Recla
*Assistant Examiner*—Gregory M. Vidovich
*Attorney, Agent, or Firm*—Arthur Freilich; Robert D. Hornbaker; Leon D. Rosen

[57] ABSTRACT

A vacuum assisted toilet wherein a vacuum is applied between upper and lower traps (40,44 in FIG. 2) of a toilet bowl outlet during a flushing, wherein the lower trap is constructed to more reliably assure that an air passage (64) above a pool of water (52) of the lower trap will quickly close near the beginning of a flushing and will remain open between flushings. The lower trap has a lower wall (50) that holds a pool of water (52) with a pool top (62) of predetermined height (A) between flushings, and has an upper wall (60) spaced above the pool top to form an air passage. The upper wall forms a narrow but tall vent (100, FIG. 4) of the air passage, which assures that the air passage will always be open between flushings, and with the narrow but tall vent being quickly closed by water rapidly flowing therethrough at the beginning of a flushing.

11 Claims, 3 Drawing Sheets

FIG. 1
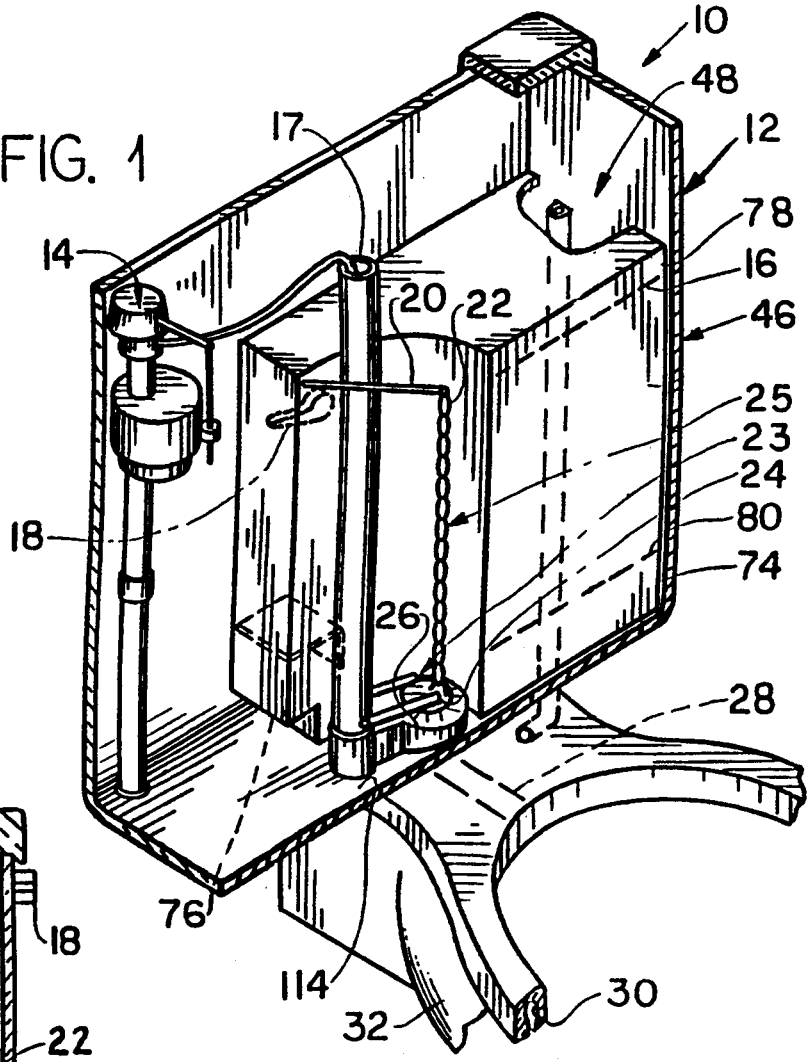
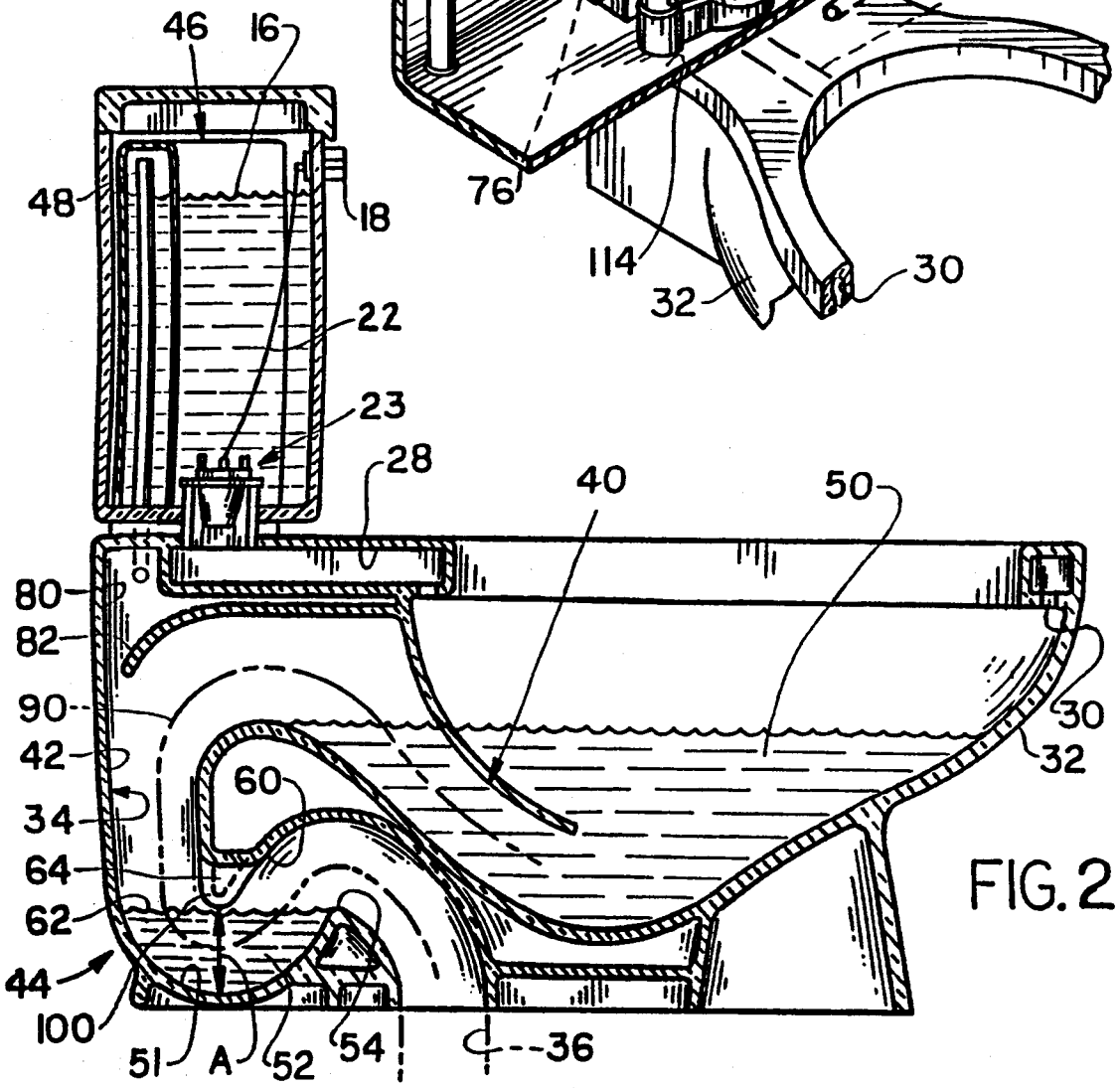
FIG. 2

VACUUM ASSIST TOILET TRAP

BACKGROUND OF THE INVENTION

Applicant's U.S. Pat. No. 5,142,712 describes a vacuum assisted toilet, wherein a vacuum is applied to the toilet bowl outlet during a flushing so that less water is required for a complete flushing. The toilet bowl outlet includes a lower trap, in addition to the usual upper trap, with a trapway extending between them. A vacuum is applied to the trapway near the beginning of a flushing. The lower trap has a lower wall that contains a pool of water, and has an upper wall spaced above the top of the pool to leave a gap between them that forms an air passage. Between flushings, the air passage must be open, or else all water in the toilet bowl might be siphoned out. On the other hand, soon after the beginning of a flushing, the lower trap must be closed against the passage of air, so that the vacuum applied to the trapway can help pull out the contents of the toilet bowl, instead of having the vacuum dissipated to the drain or sewer system.

Although the vacuum assisted toilet described in applicant's Pat. No. 5,142,712 operates fairly well, applicant has experimented with the lower trap in an attempt to obtain even better flushings. A better flushing is one which produces a more complete evacuation of the contents of the toilet bowl, using the same or less flush water. In such tests, items that both sink and float in water, such as marbles and plastic balls of different densities, are placed in the toilet bowl and the percent of these items which are removed, is measured. Better flushing might be obtained when the gap above the pool of water is smaller, but a gap of substantial height such as one centimeter (0.4 inch), is necessary to assure that air can pass through the top of the lower trap under worse conditions. Worse conditions would include cases where the toilet is mounted at an incline from the intended orientation with respect to gravity and/or manufacturing tolerances that result in a gap of reduced height. A lower trap which produced better flushings, would be of value.

SUMMARY OF THE INVENTION

In accordance with one embodiment of the present invention, a vacuum assisted toilet is described of the type that has upper and lower traps, wherein the lower trap is constructed to produce better flushing. The lower trap has a lower wall forming a container that holds a pool of water, with the pool top lying at a predetermined height. The lower trap has an upper wall, with a gap between the upper wall and the pool fop forming an air passage. The air passage has a lowermost location where the height of the air passage is a minimum. The air passage is formed so it is tall and narrow, as seen in a sectional view taken perpendicular or normal to the centerline of the toilet bowl outlet.

The lowermost location of the air passage has a maximum height that is at least one half its average width and is preferably greater than its average width. In one trap that applicant has constructed, most of the toilet bowl outlet had a circular cross section of a diameter of about 2.1 inches (54 mm). Applicant found that excellent flushing is obtained by constructing the lower trap, so a cross section of it is substantially a circle of about 2.1 inches diameter, but with a vent at the top that extends about one inch above the top of the circle, and with the vent having an average width of about 0.36 inch (9 mm).

In experimenting with lower traps for a vacuum assisted toilet, applicant has found that a lower trap constructed as a choke, will enable the vacuum to assist in flushing, although not as well as in the case of a lower trap that contains a pool of water. A choke is a part of a toilet bowl outlet wherein the walls have a "zigzag", so that the water has to suddenly change direction. This results in flush water blocking air flow, so that a vacuum applied above the choke can help draw out the contents of the toilet bowl.

The novel features of the invention are set forth with particularity in the appended claims. The invention will be best understood from the following description when read in conjunction with the accompanying drawings.

BRIEF DESCRIPTION OF THE DRAWINGS

FIG. 1 is a partial isometric view of a vacuum assisted toilet of the present invention with a portion of a container being shown cut away.

FIG. 2 is a sectional side view of the toilet of FIG. 1.

DESCRIPTION OF THE PREFERRED EMBODIMENTS

Figure 3:
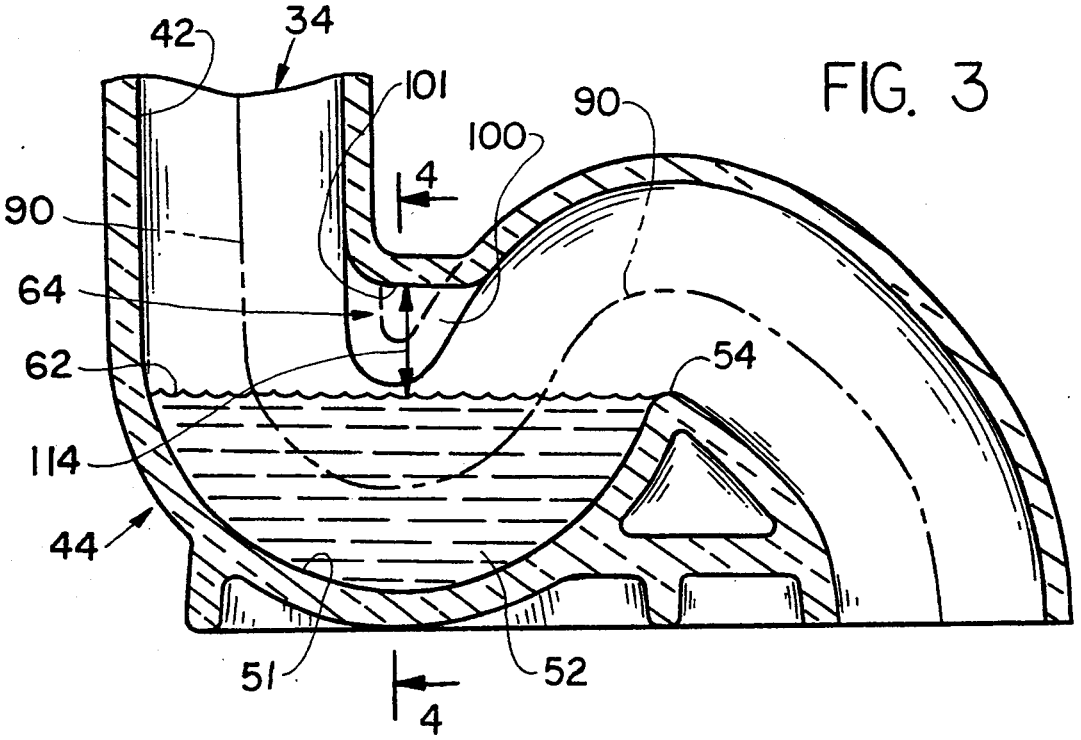
FIG. 3 is a side view of the lower trap of the toilet of FIG. 2.

FIG. 1 illustrates a vacuum assisted toilet 10 which includes a water closet or tank 12 that holds a conventional water inlet valve 14. The inlet valve dispenses water into the tank until the water reaches a predetermined high water level 16, and also dispenses water through a refill tube 17 to fill the toilet bowl. When a handle 18 of a flush valve assembly 25 is manually operated, by pivoting it, a rod 20 and chain 22 are lifted to operate a flush valve 23 by pivoting a flush valve member 24 to lift it off a primarily upwardly facing flush valve seat 26. Water in the tank flows rapidly through the seat 26 and through a water conduit 28 and through toilet bowl orifices 30 into a toilet bowl 32 (the seat is not shown). As shown in FIG. 2, the toilet bowl 32 has a toilet bowl outlet 34 that carries water and waste to a drain 36 that connects to a sewer system.

The toilet bowl outlet 34 includes an upper trap 40 coupled to the bowl 32, a trapway 42 extending generally downwardly from the upper trap, and a lower trap 44 extending from the trapway to the drain 36. A vacuum source 46 is coupled through a vacuum conduit 48 to the trapway 42, to apply a vacuum therein during flushing of the toilet. The vacuum draws water and waste from a pool of water 50 lying in the toilet bowl, to supplement the flushing forces resulting from the sudden flowing of water onto the top of the bowl pool. The application of the vacuum minimizes the amount of water which must be used in a flushing, to obtain an effective flushing wherein almost all of the contents in the pool is removed, including debris that floats and debris that sinks.

Most conventional toilets have a single trap at 40 which prevents sewer gas rising in the drain 36, from passing through the toilet bowl into the bathroom. The trap 40 forms a gas-tight seal. The lower trap 44 does not form a gas-tight seal, except during a flushing. The lower trap has a lower wall 50 that forms a container which holds a pool of water 52, at a height A (above the bottom of the pool) that is determined by the height of the downstream end 54 of the container. The lower trap has an upper wall 60 that lies above the top 62 of the pool, to leave a gap or air passage 64. The air passage 64 assures that the lower trap cannot serve as a siphon to draw out all water from the toilet bowl at the end of a flushing. However, the air passage 64 must be sealed, by the rapid flow of water therethrough near the beginning of a flushing, so that a vacuum applied to the trapway 42 will not be dissipated to the drain 36.

The vacuum and water sources of the toilet shown include a container 78 (FIG. 1) that lies within the tank 12. The container is sealed from the rest of the inside of the tank, except at a lower container opening 76 that opens to the rest of the tank. At the beginning of a flushing, when the flush valve member 24 is lifted and water begins to flow to the toilet bowl, the level of water in the tank which is originally at 16, rapidly falls, creating a vacuum at the top of the container 78. This vacuum is applied through the vacuum conduit 48 to a cavity 80 (FIG. 2) that connects to the trapway 42. The cavity 80 is partially isolated from the trapway 42 by a barrier 82 to avoid the entrance of debris into the vacuum tube. It is possible to form the tank 12 as a sealed unit, to avoid a separate container therein.

A flush cycle lasts for a period such as three seconds, during which water in the tank rapidly passes into the toilet bowl to raise the level of the pool 50 therein, and the water in the toilet bowl exits through the toilet bowl outlet 34. About 6 liters of water is used in each flushing when solid waste is present, which is about one-half that required for a toilet bowl of the same design, but without vacuum assist or a lower trap. The vacuum source 46 applies a vacuum of about ten centimeters (four inches) of water during a flushing to achieve these results. Effective use of the vacuum requires that the lower trap 44 be closed to the passage of air, early during a flushing, preferably before one-quarter of the water in the toilet bowl has left the upper trap. It is noted that for the particular toilet shown in FIGS. 1–4, most of the length of the toilet bowl outlet 42, especially near and along the lower trap, is of substantially circular cross section, with the toilet bowl outlet having a centerline 90.

Figure 4:
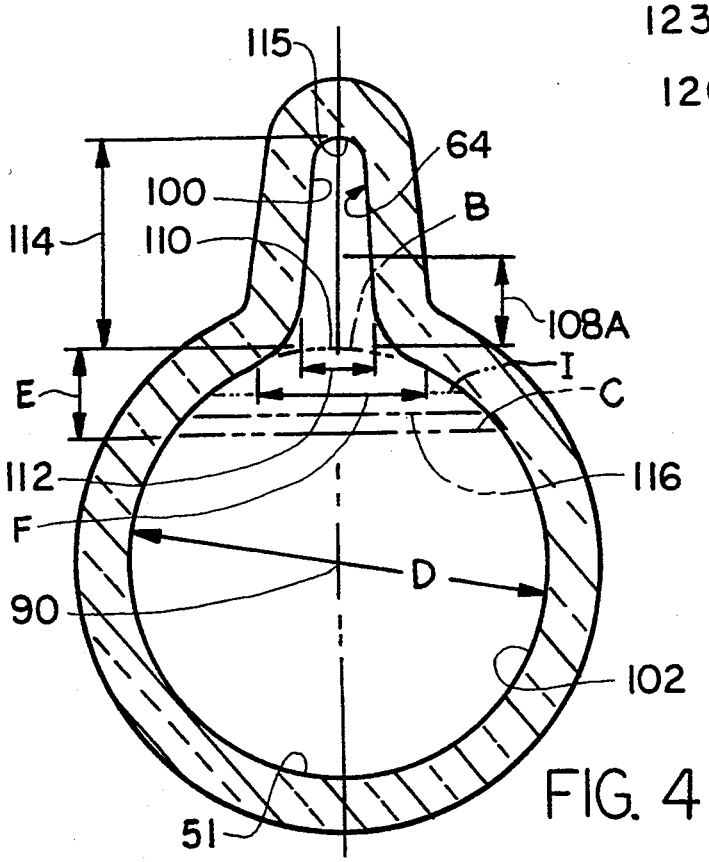
FIG. 4 is a view taken on the line 4—4 of FIG. 3.

FIG. 3 shows a lowermost location 101 along the lower trap, where the height 114 of the air passage 64 above the water pool 52 is a minimum. FIG. 4, which is a sectional view taken at location 101 (FIG. 3) of the lower trap, shows that height 114 is the maximum height at the lowermost location. Applicant constructs the lower trap so the air passage 64 includes a narrow but tall upward extension or vent 100 that forms a major portion of the air passage 64. The air passage and particularly the vent 100, is unblocked between flushings to prevent siphoning out of water, and is blocked during a flushing to contain a vacuum that assists in the flushing.

Previously, applicant constructed the lowermost portion or location along the trapway where the height of the air passage was smallest, so it was circular, as indicated by the phantom line B in FIG. 4. The rest of the trapway cross-section 102 was also circular, as it is in the present embodiment of the invention of FIG. 4. At least half of the length of the toilet bowl outlet is of substantially this circular cross-section. The previous pool top C was maintained a considerable height E below the top of the air passage, to assure that the air passage would always be open at the end of a flushing and between flushings, despite poor installation of a toilet at a tilt and despite manufacturing tolerances. In a toilet bowl outlet of circular cross section, as viewed perpendicular or normal to the centerline 90 of the toilet bowl outlet, where the toilet bowl outlet had a diameter D of two and one-eighth inch (54 mm) applicant constructed the lower trap so the distance E was about 0.5 inch (13 mm). Although this resulted in a flushing which was about as good as an ordinary regular toilet of the same construction, but used half as much water, applicant has experimented to try to obtain even better flushing.

As shown in FIG. 4, applicant constructs the lower trap so its upper walls form the vent 100 that is tall and thin, and constructs the lower trap so the top of the pool is approximately at the location 110 which is at about the bottom of the vent 100, and which is at about the top of the circle at B which defines most of the rest of the cross section of the lower trap. The vent 100 has a mean average width 112, of about 0.36 inch (9 mm) which is much smaller than the average width F of about 0.93 inch (24 mm) of the prior gap. Applicant initially tried using a vent with a height 108A which was the same as the height E of his previous lower trap. This resulted in earlier closing of the lower trap during a flushing, resulting in a better flushing (higher percentage of marbles and plastic balls flushed out) than for applicant's prior lower trap whose top was defined by the circle portion 102. It appears that the much narrower vent is quickly flooded and thereby sealed with flush water, so a vacuum is established in the trapway earlier during a flushing, such as perhaps one-half second earlier during the period of about three seconds for a flushing.

Applicant experimented using vents of different heights and widths, and found that the trapway illustrated in FIG. 4 gave the best flushing. The substantially circular cross section extends by at least 270° (three-fourths of a circle) and actually extends by about 320°. It might be supposed that a vent having a height 108A would provide for the best flushing while still leaving about one-half inch height to prevent closing of the air passage between flushing. However, applicant has found that a vent height 114 of about one inch for the toilet bowl outlet diameter D of two and one-eighth inch, resulted in the best flushing. The upward extension at vent 100 preferably has an average width 112 which is less than one-third the diameter D of the toilet bowl outlet. With the top of the pool lying at 110, the air passage 64 also has an average width 112 which is less than one-third the maximum width D of the toilet bowl. The height 114 of the vent preferably is at least 75% of its average (median or mean) width 112, and is more preferably at least as great as its average width 112.

If the top of a water pool were at the height 116, and the top wall of the air passage were at B which is a continuation of the circle 102, then the cross-sectional area between the pool top 116 and location B would equal the cross-sectional area of the vent 100 above the pool top at 110. However, the air passage at vent 100 has a much greater height (more than twice as much) than the air passage between 116 and B which is the imaginary topmost part of a circular bowl outlet of the same area as the vent 100.

Figure 5:
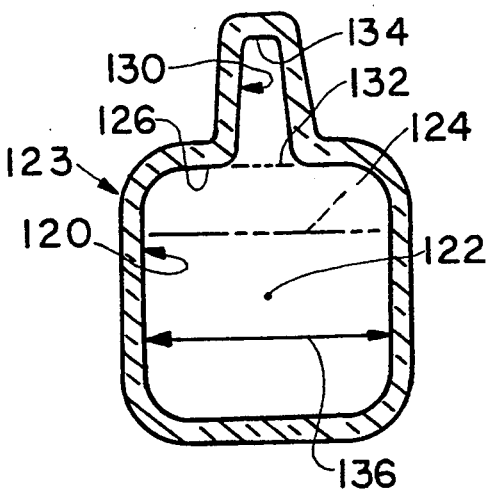
FIG. 5 is a sectional view of a lower trap constructed in accordance with another embodiment of the invention.

FIG. 5 illustrates a toilet bowl outlet 120 of largely rectangular cross section and shows a location along the centerline 122 which is at the location of a lower trap 123. If the lower trap were constructed in accordance with applicant's previous patent, the lower trap pool would have a pool top at 124 which was spaced one-half inch below the upper side 126 of the rectangular cross section. However, applicant provides a vent 130 of about the same construction as that of FIG. 4, and constructs the lower trap so the water line is at 132, where it lies about one inch below the top 134 of the vent. The particular toilet outlet has a width 136 and height that are each about two inches. The average width of the vent 130 is preferably no more than 50 percent of the width 136 of the bowl outlet cross-section, and is preferably less than one-third, with the maximum vent height preferably being at least as great as its average width.

Thus, applicant provides a lower trap for a vacuum assisted toilet which has a vacuum source coupled to a trapway lying between upper and lower traps, wherein the lower trap has a vent at the top that forms an air passage. As seen in a sectional view taken normal to the centerline of the toilet bowl outlet along the lower trap, a lowermost location along the air passage has a maximum vertical height that is preferably at least 75% and more preferably at least 100%, of the average horizontal width of the vent. The air passage, which includes the vent, extends higher above the bottom wall of the toilet bowl outlet as seen in a sectional view perpendicular to the centerline, than other cross sections (e.g. circular or rectangular) of the toilet bowl outlet, such as immediately upstream or downstream of the vent. For lower traps where all but the top lies on an imaginary circle or rectangle (with rounded corners), the vent or air passage top extends more than one-eighth inch and preferably more than one-quarter inch higher than the top of the imaginary circle or rectangle. The lower trap is useful in a variety of vacuum assisted toilets, including those where the pressure of the vacuum results from the drop in tank water level, and those where pressured water (such as produced by the force of a spring or weight) produces a vacuum.

Figure 6:
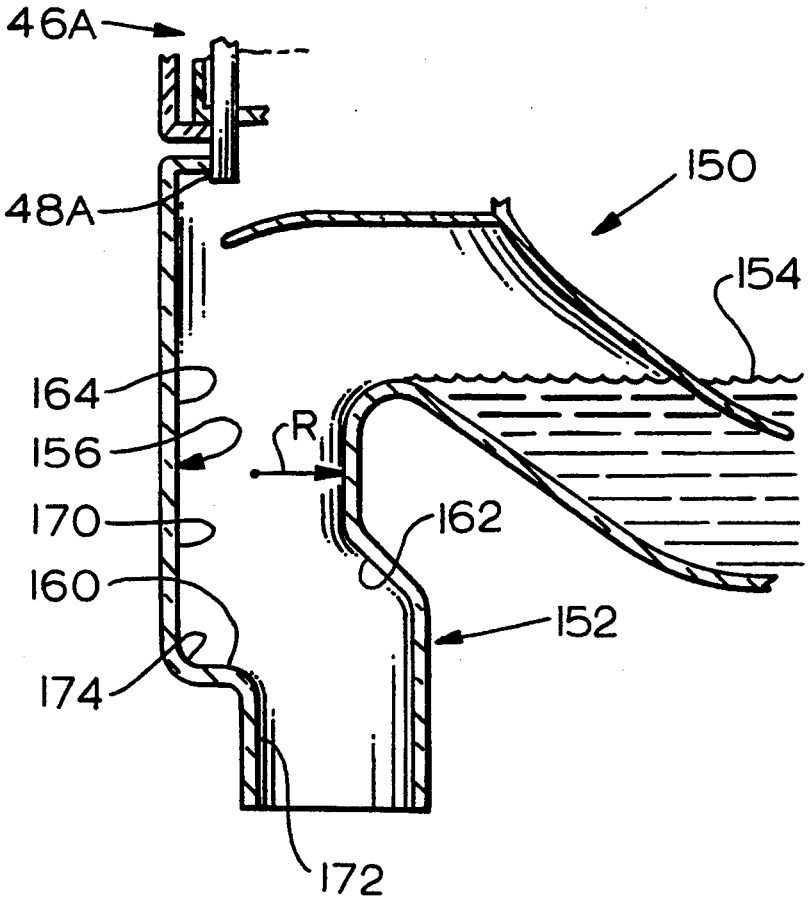
FIG. 6 is a partial sectional side view of a vacuum assisted toilet constructed in accordance with another embodiment of the invention, which employs a choke as the lower trap.

In experimenting with lower traps, applicant constructed a vacuum assisted toilet shown at 150 in applicant's FIG. 6, with a lower trap 152 in the shape of a choke. Applicant found that this lower trap 152 was blocked by water during a flushing, so a vacuum created by a vacuum source 46A of the same construction as shown in FIG. 2, was effective in producing a somewhat acceptable flush using less water than in previous similar toilet without any vacuum assist. The lower trap 152 is of a shape used in some previous toilets without vacuum assist. When water 154 in the toilet bowl rapidly moves down a trapway 156, it appears that the water splashes against a sharply angled, primarily upwardly-facing outer wall 160 of the lower trap, and against an opposite partially downwardly-facing inner wall 162. This results in blockage of the toilet bowl outlet 164 at the lower trap, so that a vacuum applied through a vacuum conduit 48A is not lost to the drain, but helps to draw water out of the toilet bowl. However, the closing lasts for a shorter period of time than for a lower trap that has a pool of water and a small gap above it, or one with no gap above the pool but with a bypass air valve that closes during a flushing, and generally does not effectively use the vacuum. The lower trap 152 essentially has upper and lower bowl outlet parts 170, 172 which are offset from each other, and with a sharp bend at 174 which has a radius of curvature no more than the average cross-sectional radius R of the toilet bowl outlet. The particular offset shown in FIG. 6 is equal to the radius R, and is about one inch for a toilet bowl outlet having a diameter or width of two inches, and the offset should be at least one-fourth the radius of the bowl outlet along a distance no more than half the width R of the bowl outlet.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A vacuum assisted toilet which includes a toilet bowl outlet having a centerline and having upper and lower traps and a trapway between them to which a vacuum source is applied during a toilet flushing, characterized by:

said lower trap has upper and lower trap walls, with said lower trap wall being formed to hold a pool of water and with said lower trap wall having a downstream end of a predetermined height that defines a pool top of said predetermined height at times between toilet flushings, and said upper trap wall forms an air passage that lies above said pool top, with said upper trap wall having a lowermost location where the height of said air passage,above said pool top is a minimum, as compared to other locations taken normal to said centerline;

said air passage above said pool top, as seen in a sectional view taken normal to said centerline at said lowermost location of said air passage, has a vertical height that is more than 75% of its average horizontal width wherein said average horizontal width is less than one half the maximum cross sectional width of said lower trap.

2. The vacuum assisted toilet described in claim 1 wherein:

a majority of the length of said outlet, including said lower trap, is of substantially circular cross section, with the top of the cross section of said lower trap at said location having an upward extension which forms at least part of said air passage and with said .upward extension having a height which is at least as great as its average width.

3. The vacuum assisted toilet described in claim 1 wherein:

said outlet, including said lower trap, is of primarily rectangular cross section, with the top of the cross section of said lower trap having an upward extension which forms at least part of said air passage and with said upward extension having a maximum height that is at least as great as its average width.

4. The vacuum assisted toilet described in claim 1 wherein:

at least about half of the length of said bowl outlet has a substantially uniform predetermined cross section, and the cross section at said lowermost location is substantially said predetermined cross section except that it includes an upwardly extending vent in said upper wall which has a height that is at least as great as its average width;

the distance between said pool top and the bottom of said vent is less than the height of said vent.

5. The toilet described in claim 4 wherein:

said vent has a maximum height which is at least as great as its average width.

6. The toilet described in claim 4 wherein:

said downstream end of said lower trap wall and the bottom of said vent both lie in substantially the same horizontal plane.

7. A vacuum assisted toilet which includes a toilet bowl, a source which supplies water to said toilet bowl at the beginning of a flushing, and a bowl outlet for carrying water in a downstream direction to a drain, said bowl outlet having a centerline, and said bowl outlet includes an upper trap, a trapway which extends generally downwardly from said upper trap, and a lower trap which connects the lower end of said trapway to the drain, wherein a vacuum source is coupled to said trapway to apply a vacuum thereto during a flushing, and wherein said lower trap comprises a water container that holds a pool of water, with said water container having a downstream end of predetermined height that defines a pool top lying at said predetermined height between flushings, and said lower trap has upper and lower walls, and wherein said bowl outlet has locations of substantially constant cross-section, characterized by:

said upper wall of said lower trap form an air passage that fluidically connects locations upstream and downstream of said lower trap, with said upper wall having a minimum height above said pool top at at least a first location along said air passage, and as seen in a sectional view taken normal to said centerline at said first location, said air passage above said pool top has a greater height than an imaginary topmost part of said bowl outlet of said predetermined cross-section which has the same cross-sectional area, with the average horizontal width of said air passage being less than one-third of the maximum horizontal width of said bowl outlet.

8. The toilet described in claim 7 wherein:

at least about half of the length of said toilet bowl outlet has a substantially constant predetermined cross section, as seen in sectional views taken normal to said centerline, and in one of said sectional views that includes said first location of said air passage;

at said first location, said lower trap has an upward extension which forms at least part of said air passage and that extends above the top of said predetermined cross-section, and said pool top lies at substantially the bottom of said upward extension.

9. A vacuum assisted toilet which includes a toilet bowl, a bowl outlet that has upper and lower traps and a trapway between said traps, and a source that flows water into said bowl at the beginning of a flushing and a vacuum source that applies a vacuum to said trapway during a flushing, characterized by:

said bowl outlet has a centerline and upper and lower walls at said lower trap, said lower wall forming a container to hold a pool of water that has a pool top, with said container having a downstream end lying at the level of said top of said pool of water, and said upper wall forming an air passage that lies above said pool top, with said upper wall having an air passage top wall with a lowermost location where the height of said air passage above said pool top is a minimum;

as seen in a sectional view of said bowl Outlet taken normal to said centerline at said lowermost location, all but the top of said bowl outlet lies substantially coincident with an imaginary circle of a predetermined radius, with said air passage top wall forming an upwardly extending vent that projects above the top of said imaginary circle and with said vent having a height that is at least as great as its average width, and the distance between said pool top and the bottom of said vent is less than the height of said vent.

10. A vacuum assisted toilet which includes a toilet bowl, a bowl outlet that has upper and lower traps and a trapway between said traps, and a water source and a vacuum source that flows water into said bowl at the beginning of a flushing and that applies a vacuum to said trapway during a flushing, respectively, characterized by:

said bowl outlet has a centerline and upper and lower walls at said lower trap, said lower wall forming a container to hold a pool of water that has a pool top, with said container having a downstream end lying at the same level as said pool top, and said upper wall forming an air passage that lies above said pool top, with said air passage having an air passage top wall with a lowermost location where the height of said upper wall above said pool top is a minimum;

as seen in a sectional view of said bowl outlet taken normal to said centerline at said lowermost location, all but the top of said bowl outlet lies substantially coincident with an imaginary rectangle that has rounded corners, with said air passage top wall at said lowermost location extending above the top of said imaginary rectangle to form an upwardly extending vent in said upper wall that has a height that is at least as great as its average width, and the distance between said pool top and the bottom of said vent is less than the height of said vent.

11. A vacuum assisted toilet which includes a toilet bowl outlet to which a vacuum is applied, with said outlet having upper and lower traps and a trapway between them, wherein said lower trap has upper and lower trap walls and is formed to hold a pool of water with the downstream end of said lower trap wall defining the top of said pool, said upper trap wall forming an air passage above said top of said pool, with said air passage having a lowermost location along the length of said bowl outlet where the height of said air passage above said top of said pool is a minimum, wherein:

said lower trap is formed so at said lowermost location said top wall has an upwardly projecting vent which forms at least part of said air passage and that vertically extending side walls wherein said vent has an average width that is less than one-half of the maximum width of said lower trap, and with said top of said pool lying closer to the bottom of said vent than the maximum height of said vent.

* * * * *

UNITED STATES PATENT AND TRADEMARK OFFICE

CERTIFICATE OF CORRECTION

PATENT NO. : 5,404,597
DATED : April 11,1995
INVENTOR(S) : Arnold Hennessy

It is certified that error appears in the above-indentified patent and that said Letters Patent is hereby corrected as shown below:

Column 8, line 58, after "that" insert -- has --.

Signed and Sealed this

Eighth Day of August, 1995

*Attest:*

*Attesting Officer*

BRUCE LEHMAN

*Commissioner of Patents and Trademarks*